US009452518B2

(12) United States Patent
Perry

(10) Patent No.: US 9,452,518 B2
(45) Date of Patent: Sep. 27, 2016

(54) HAMMER DEVICE

(71) Applicant: Robert Perry, Simsbury, CT (US)

(72) Inventor: Robert Perry, Simsbury, CT (US)

( * ) Notice: Subject to any disclaimer, the term of this patent is extended or adjusted under 35 U.S.C. 154(b) by 193 days.

(21) Appl. No.: 14/518,179

(22) Filed: Oct. 20, 2014

(65) Prior Publication Data

US 2015/0107418 A1 Apr. 23, 2015

Related U.S. Application Data

(60) Provisional application No. 61/893,422, filed on Oct. 21, 2013.

(51) Int. Cl.
*B25D 1/14* (2006.01)
*B25G 1/10* (2006.01)

(52) U.S. Cl.
CPC . *B25D 1/14* (2013.01); *B25G 1/10* (2013.01); *B25G 1/102* (2013.01); *B25D 2222/42* (2013.01)

(58) Field of Classification Search
CPC ..... B25G 1/10; B25G 1/102; B25D 1/14; B25D 2222/42
USPC ..... 81/26
See application file for complete search history.

(56) References Cited

U.S. PATENT DOCUMENTS

| | | | | | |
|---|---|---|---|---|---|
| 758,482 | A * | 4/1904 | Smith | B25G 3/32 | 16/422 |
| D140,908 | S | 4/1945 | Homme | | |
| D195,996 | S | 8/1963 | Caramelli | | |
| D290,334 | S | 6/1987 | Reynolds, Jr. | | |
| D362,880 | S | 10/1995 | Blezek | | |
| 5,454,565 | A | 10/1995 | Ramirez | | |
| D384,713 | S * | 10/1997 | Eckmann | D21/682 | |
| 6,023,997 | A * | 2/2000 | Willis | B25D 1/02 | 81/20 |
| 7,093,669 | B2 * | 8/2006 | Walsh | B25D 1/16 | 173/162.2 |
| 7,480,964 | B2 * | 1/2009 | Vidal | B25G 1/102 | 16/110.1 |
| D589,769 | S * | 4/2009 | Timm | D8/14 | |
| D620,776 | S * | 8/2010 | Prachthauser | D8/81 | |
| 2008/0189930 | A1 | 8/2008 | Chen | | |

* cited by examiner

*Primary Examiner* — Hadi Shakeri
(74) *Attorney, Agent, or Firm* — Lucas & Mercanti, LLP

(57) ABSTRACT

An improved sledge hammer device is disclosed having first and second head portions attached to a central rod and a hand guard which is substantially parallel to the central rod. In operation, the hammer is held by the central rod, or optionally by the hand guard and is brought vertically or horizontally in contact with its target by the user. The device is particularly advantageous in situations where the typical central handle and/or wide swing arc is impractical due to space constraints.

8 Claims, 3 Drawing Sheets

HAMMER DEVICE

CROSS REFERENCE TO RELATED APPLICATIONS

This application claims benefit of priority under 35 U.S.C. 119(e) of U.S. Provisional Application Ser. No. 61/893,422 filed Oct. 21, 2013, the contents of which are incorporated herein by reference.

BACKGROUND OF THE INVENTION

Over the years, there have been minimal improvements made to hammers and various impact hand tools. For example, manufacturers have modified the hammer head in various ways to improve the ability to perform certain functions, like driving nails, or making demolition more efficient. Various claw designs have also been developed for specific tasks. Almost universally, however, the head portion of hammer is attached way to a perpendicular handle portion. While the handle is a highly useful appendage for the hammer in most cases, there are situations where the handle portion of a hammer becomes a drawback. For example, there are situations in demolition or steel girder assembly in commercial building construction where confined work spaces or space limitations prevent typical swings of a sledge hammer with its long perpendicular handle. Simply removing or shortening the handle is not a satisfactory solution. Such techniques make the head portion impractical to handle and/or significantly reduce the impact force the craftsman desires to deliver to the target. It would be highly desirable to be able to deliver significant hammer impact force to a target in a confined range. The present invention addresses this need.

SUMMARY OF THE INVENTION

In one preferred aspect, the present invention relates to hammer-like device which lacks the typical horizontal handle. The device includes a first and a second head portion which are attached to a substantially straight central rod or member. Each head portion has a front section and a rear section. The front section of each head portion have an impact surface region, while the rear portions of each head portion are fixedly attached to the substantially straight central member, so that the front portions of each head portion face outwardly on opposite sides of the central member. The central member or rod has a hand grasping region. The diameter of the central member is substantially narrower than the cross-section of the head portions, thus giving this portion of the hammer an appearance similar to a bar-bell. The inventive devices include a guard portion optionally releaseably attached to the first and second head portions. The guard is designed to allow a hand, whether gloved or not, to securely grasp the central rod and extends parallel over the hand grasping region of the central member. Other and further aspects of the invention are provided in the detailed description and drawings described below.

One advantage of the present invention is that it provides an alternative to hammers having a central handle, allowing it to be used in areas where swinging the handle is not practical or possible due to space constraints.

Throughout this description, the device will be referred to as a "hammer" or "sledgehammer". The terms are meant to be used interchangeably and not to the exclusion of one or the other. It will be clear from the description that the invention embraces all forms of impact delivering devices, regardless of size. In fact, the size and weight of devices in accordance with this invention will vary, depending upon the purpose intended by the craftsman. Such purposes include all construction fields. The hammer is especially useful for use in tight places where ironwork, demolition, welding, and carpentry, etc. are done.

BRIEF DESCRIPTION OF THE DRAWINGS

The present invention will be further understood and appreciated by reading the following description in conjunction with the accompanying drawings, in which.

DETAILED DESCRIPTION OF THE INVENTION

Figure 1:
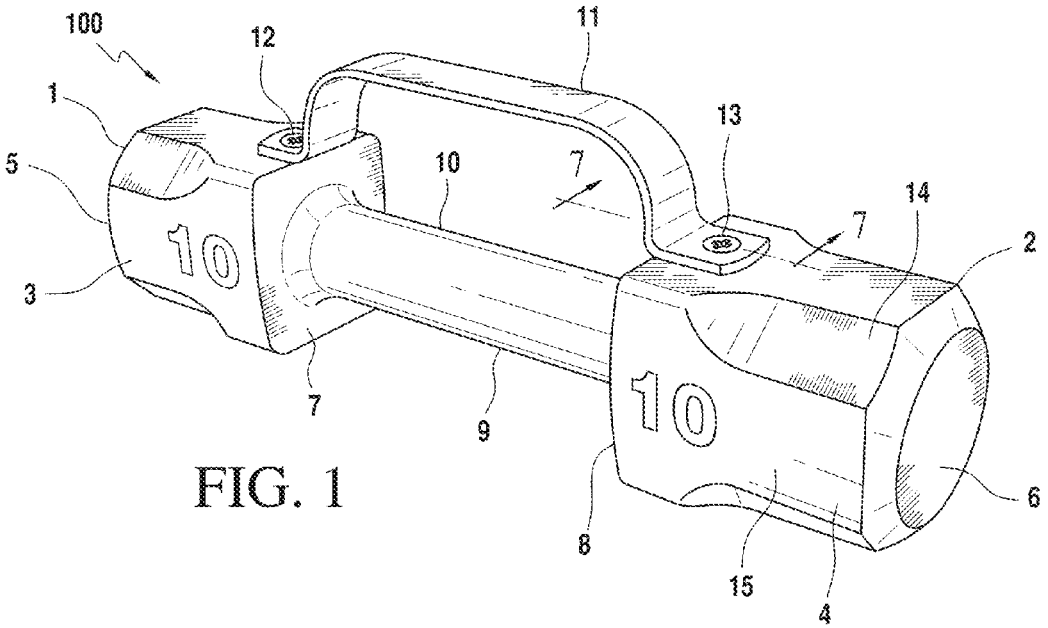
FIG. 1 is a perspective of a hammer in accordance with the present invention.

Turning now to the Figures, there is provided a hammer or sledgehammer 100 having a first and a second head portion, 1 and 2, respectively, each head portion having a front section 3 and 4 respectively, and a rear section 7 and 8 respectively. The front sections of each head portion also have impact surface regions 5 and 6 respectively. The rear sections 7 and 8 of each head portion are fixedly attached to a substantially straight central member 9 so that the front portions 3 and 4 of each head portion 1 and 2 face outwardly on opposite sides of the central member 9.

The central member 9 has sufficient length between the head portions so that a hand grasping region 10 is provided. The diameter of the central rod or member 9 is also substantially narrower than the cross-section of the head portions 1 and 2.

Figure 7:
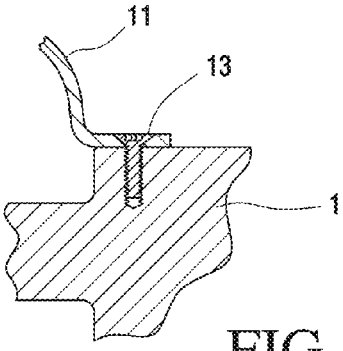
FIG. 7 is a sectional view of a hammer in accordance with the invention, taken through the hand guard fastener in FIG. 1.

The inventive hammers in accordance with the present invention also include a guard portion 11 extending parallel over the hand grasping region 10 of the central member 9. The guard is preferably releaseably attached to the first and second head portions 1 and 2. FIGS. 1 and 7 show an embodiment wherein the guard 11 is attached to the head portions using screws 12 and 13. In an alternative embodiment, the guard is permanently attached to the head portions.

As shown in FIG. 1, the impact surface regions 5 and 6 respectively of the first and second head portions 1 and 2 can be substantially circular in shape. The impact surface regions of the hammer head portions taper back to a region of the front sections 3 and 4 of each of the first and second head portions 1 and 2 which have a hexagonal shape and cross section. FIG. 1 also shows the hexagonal shaped head portions including alternating beveled surfaces 14 and straight surfaces 15.

Figure 8:
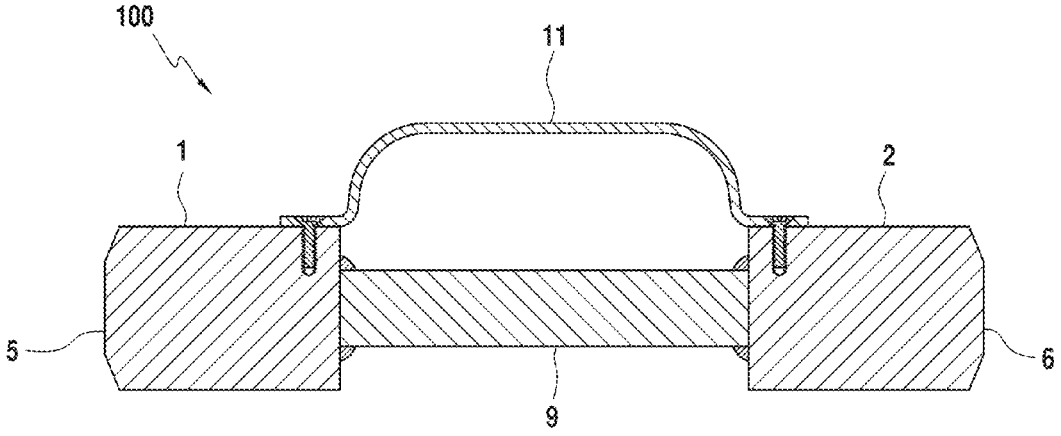
FIG. 8 is a cross-sectional view of a hammer in accordance with an aspect of the invention showing the hammer heads welded to the central rod.

Hammers made in accordance with the present invention can be made in any manner known to those of ordinary skill. For example, the head portions and central member can be cast or forged as a single unit and the guard portion is separately cast or extruded and attached either with screws or similar functioning fastening means to the head portions so as to be releasable or welded to the head portions as a permanent part of the devices. Alternatively, as shown in FIG. 8, the hammers can be made wherein the head portions are welded to the central member and the guard is affixed thereto as mentioned above.

Figure 2:
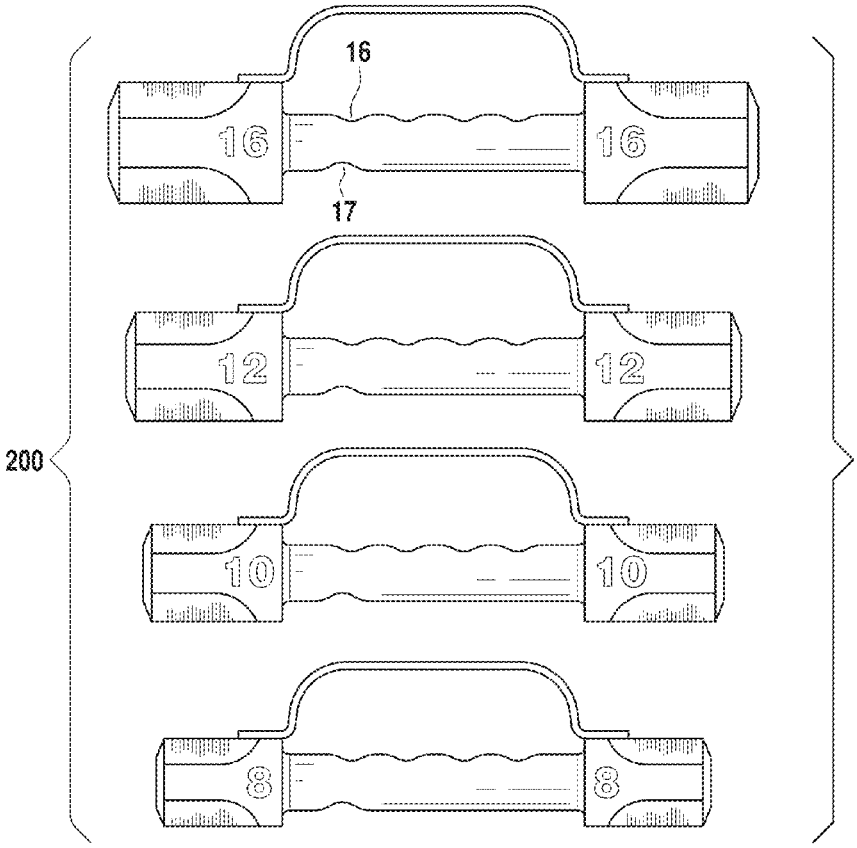
FIG. 2 is a set of sledgehammers in accordance with the present invention, each having different weights.

The hammers can be constructed of any suitable steel or metal alloy and may include, if desired, rubber or other suitable polymeric coverings for the head portions. The central member 9 is also formed of similar materials as the head portions or any other suitable steel material. It is also contemplated that the artisan will benefit from having a plurality of the devices at his disposal. FIG. 2 shows a multiple hammer set 200 with each hammer having a different weight and thus different end uses.

Figure 3:
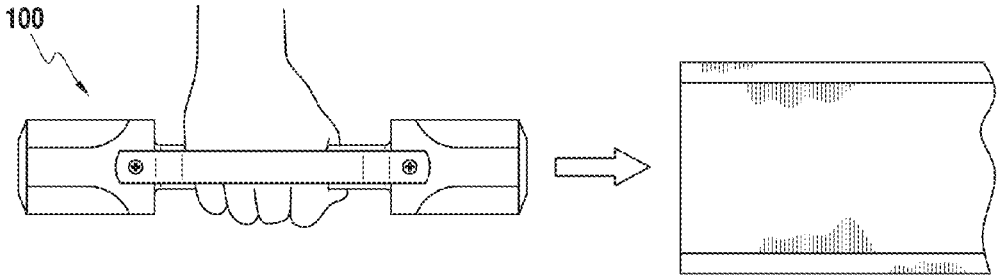
FIGS. 3 and 4 together show a sledgehammer in accordance with the invention in use, horizontally moving a beam into place.
Figure 4:
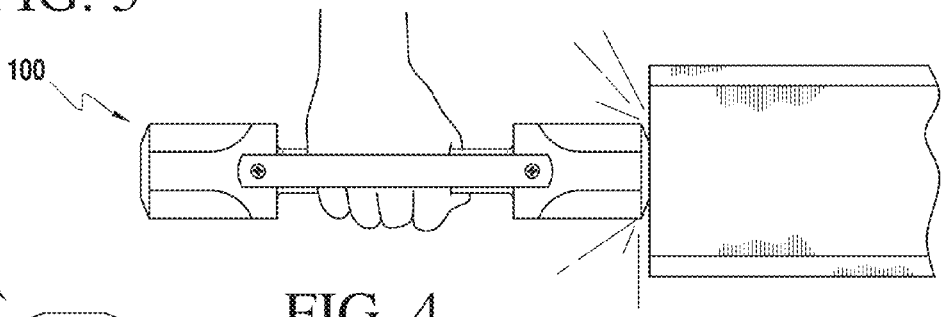
Figure 5:
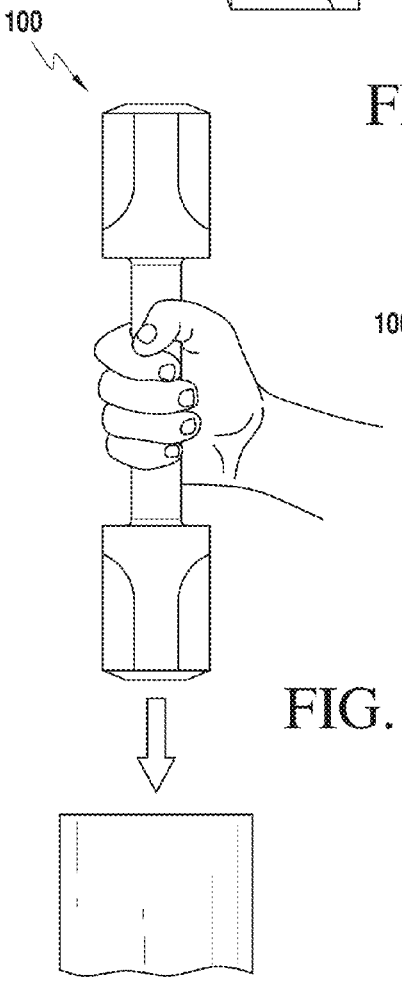
FIG. 5 shows a sledgehammer in accordance with the present being used vertically.

The hammers of the present invention have a similarity in shape to a bar-bell. Referring to FIGS. 3-4, the devices allow force to be applied horizontally without having to resort to wide-arcing swings commonly required by the typical sledgehammer. FIG. 5 shows the inventive sledgehammer being used to apply a force vertically to an object, again without the need to resort to wide swinging arcs to generate sufficient force against the desired target.

Figure 6:
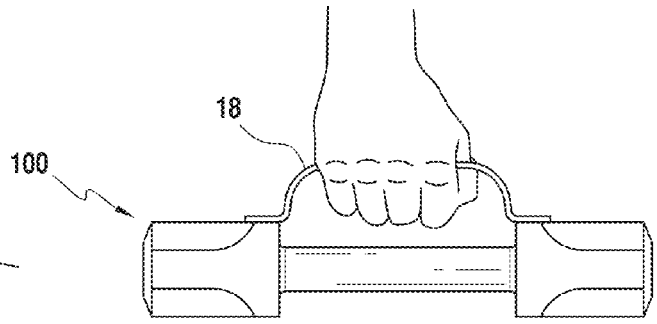
FIG. 6 shows an alternative embodiment of the inventive hammer in use by holding the device by the hand guard.
Figure 9:
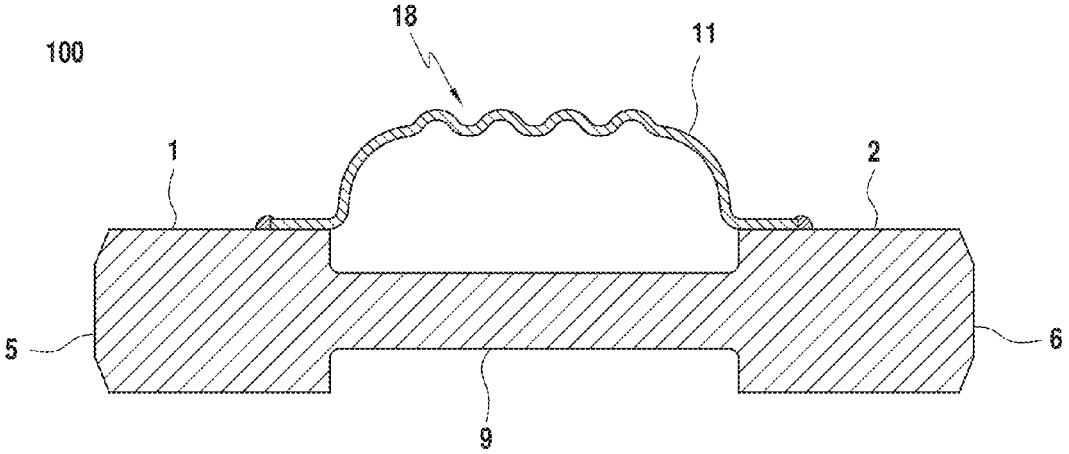
FIG. 9 is a cross-sectional view of an alternative embodiment showing the guard having indentations for fingers.

In one alternative embodiment of the invention, the central member 9 includes a series of indentations 16 along a single side for receiving fingers and a single thumb indentation 17 on the opposite side of the central member. See FIG. 2. A further embodiment of the invention includes a hand grasping region 18 on the guard 11. The hand grasping region 18 on the guard 10 can preferably also be contoured for easier optional gripping when used as shown in FIG. 6. FIG. 9 provides an example of a still further embodiment of the invention wherein the hand grasping region 18 includes indentations thereon for accepting the fingers and thumb of either hand as mentioned above.

The present invention has been described with reference to a preferred embodiment. It should be understood that the scope of the present invention is broadly defined by the claim and is not intended to be limited to the specific embodiment disclosed herein.

What is claimed:

1. A hammer, comprising:

a) a first and a second head portion, each of head portion having a front section and a rear section, the front sections of each head portion having an impact surface region and the rear section of each head portion fixedly attached to a substantially straight central member so that the front portions of each head portion face outwardly on opposite sides of the central member, the impact surface regions of the first and second head portions being substantially circular in shape, each of the front sections of each of the first and second head portions having a hexagonal shape including alternating beveled and straight surfaces, wherein one of said straight surfaces for each of the first and second head portions defining a top surface on a same plane that extends parallel over the central member;

b) the central member having a hand grasping region and having a diameter substantially narrower than the cross-section of the head portions; and c) a guard portion extending parallel over the hand grasping region of the central member attached to the corresponding top surface of the first and second head portion adjacent said rear section;

whereby in operation the hammer is held by either the central member or the guard portion and brought vertically or horizontally in contact with a target allowing the hammer to be used in areas where swinging motion is not possible due to space constrains.

2. The hammer of claim 1, wherein the guard portion is releaseably attached to the first and second head portions.

3. The hammer of claim 1, wherein the head portions and central member are cast or forged as a single unit.

4. The hammer of claim 1, wherein the head portions is welded to the central member.

5. The hammer of claim 1, wherein the head portions are formed out of steel.

6. The hammer of claim 1, wherein the central member includes a series of indentations along a first side for receiving fingers and a single indentation on the opposite side of the first side for receiving a thumb.

7. The hammer of claim 1, wherein the guard portion includes a hand grasping region.

8. The hammer of claim 7, wherein the hand grasping region of the guard portion includes a series of indentations for receiving fingers.

* * * * *